US007533883B2

(12) United States Patent
Moeller

(10) Patent No.: US 7,533,883 B2
(45) Date of Patent: May 19, 2009

(54) SHEET CONVEYOR FOR CONVEYING INDIVIDUAL SHEETS

(75) Inventor: Siegfried Moeller, Rottweil (DE)

(73) Assignee: BDT AG, Rottweil (DE)

( * ) Notice: Subject to any disclaimer, the term of this patent is extended or adjusted under 35 U.S.C. 154(b) by 435 days.

(21) Appl. No.: 11/267,710

(22) Filed: Nov. 4, 2005

(65) Prior Publication Data

US 2006/0113726 A1 Jun. 1, 2006

(30) Foreign Application Priority Data

Nov. 5, 2004 (DE) ..... 10 2004 054 021

(51) Int. Cl.
*B65H 31/26* (2006.01)

(52) U.S. Cl. ..... 271/220; 271/314; 271/184

(58) Field of Classification Search ..... 271/314, 271/220, 902, 184, 109; 270/58.27, 58.12, 270/58.16, 58.17
See application file for complete search history.

(56) References Cited

U.S. PATENT DOCUMENTS

| | | | | |
|---|---|---|---|---|
| 3,421,757 | A * | 1/1969 | Boisseau | 271/182 |
| 4,084,809 | A * | 4/1978 | Looney | 271/220 |
| 4,883,265 | A * | 11/1989 | Iida et al. | 271/220 |
| 5,288,062 | A * | 2/1994 | Rizzolo et al. | 270/58.12 |
| 5,473,420 | A * | 12/1995 | Rizzolo et al. | 399/107 |
| 5,597,251 | A * | 1/1997 | Suzuki et al. | 400/645.4 |
| 5,761,580 | A * | 6/1998 | Harada et al. | 399/167 |
| 6,171,628 | B1 * | 1/2001 | Ueno | 426/500 |
| 6,193,232 | B1 * | 2/2001 | Regimbal et al. | 271/272 |
| 6,220,592 | B1 * | 4/2001 | Watanabe et al. | 271/241 |
| 6,237,909 | B1 * | 5/2001 | Carter et al. | 271/110 |
| 6,264,193 | B1 * | 7/2001 | Moeller | 271/220 |
| 6,264,194 | B1 * | 7/2001 | Hayashi et al. | 271/220 |
| 6,286,828 | B1 * | 9/2001 | Adema | 271/186 |
| 6,352,253 | B1 * | 3/2002 | Hayakawa et al. | 270/58.12 |
| 6,412,774 | B1 * | 7/2002 | Saito et al. | 271/220 |
| 6,601,846 | B2 * | 8/2003 | Saito et al. | 271/226 |
| 6,768,235 | B2 * | 7/2004 | Tsujimoto et al. | 310/75 R |
| 6,962,331 | B2 * | 11/2005 | Matsumoto et al. | 270/58.09 |
| 7,261,289 | B2 * | 8/2007 | Lee et al. | 271/10.04 |

FOREIGN PATENT DOCUMENTS

DE 198 44 271 C1 7/2000

* cited by examiner

*Primary Examiner*—Patrick H Mackey
*Assistant Examiner*—Jeremy Severson
(74) *Attorney, Agent, or Firm*—Baker Botts L.L.P.

(57) ABSTRACT

A sheet conveyance system has at least one driven conveying shaft, with a variable spacing of the driven conveying shaft from the sheet stack. The driven conveying shaft includes at least one sheet conveyor that acts on the sheet to be conveyed with a friction coating. A toothed wheel is fixedly disposed on the conveying shaft, whereby this toothed wheel is enclosed by an outer ring that supports the friction coating and has an inner toothing constantly meshes with the outer toothing. The partial circle diameter of the toothed wheel is smaller than the inner toothing. A transferred force acts on the outer ring such that it is placed with a contact force onto the sheet. A spacer maintains a fixed spacing between the axis of rotation of the toothed wheel and the axis of rotation of the outer ring.

18 Claims, 3 Drawing Sheets

SHEET CONVEYOR FOR CONVEYING INDIVIDUAL SHEETS

CROSS-REFERENCE TO RELATED APPLICATIONS

This application claims priority from German Patent Application No. 10 2004 054 021.7, which was filed on Nov. 5, 2004, and is incorporated herein by reference in its entirety.

TECHNICAL FIELD

The present invention relates to a sheet conveyor for conveying individual sheets.

BACKGROUND

Such a sheet conveyor is described, for example, in the patent application DE 198 44 271 C1. The essential elements of the known sheet conveyor are an outer ring having a friction coating and a toothed wheel of smaller diameter that constantly meshes with the inner toothing of the outer ring. The outer ring is set into rotation by the toothed wheel and placed onto the sheet stack by a force having a force component in order to displace the uppermost sheet of the stack. The contact point of the outer ring on the sheet in reference to the direction of conveyance TR is always behind the engagement point of the driving toothed wheel in the inner toothing of the outer ring so that the sheet is pulled. When the sheet is blocked, the outer ring is raised above the driving toothed wheel, so that the friction force between the friction coating of the outer ring and the sheet to be conveyed is reduced.

The known sheet conveyor comprises two lever systems, namely a first lever system that enforces the tooth engagement between the toothed wheel and the inner toothing of the outer ring and determines the contact force on the sheet as well as a second lever system that has an effective connection with an optical sensor and serves for detecting the deflection of the outer ring. The contact force of the outer ring on the sheet varies depending on the deflection of the lever and increases continuously. The necessary contact force of the outer ring amounts to approximately IN, thus necessitating a plurality of motor steps until this force is reached. Should the sheet stack be compressed by the contact force, the contact force is reduced and the required contact force of approximately IN decreases.

A similar device is known from the patent application U.S. Pat. No. 6,193,232 B1.

SUMMARY

The object underlying the present invention is to suggest a sheet conveyor for conveying individual sheets that has a simpler design and thus can be manufactured more cost-effectively and that generates a constant contact force of the outer ring on the sheet in a wide range of the deflection of the conveyor.

This object can be achieved by a sheet conveyance system for conveying individual sheets on a sheet stack, comprising at least one driven conveying shaft, whose spacing from the sheet stack is variable and that contains at least one sheet conveyor that acts with a friction coating on a sheet to be conveyed, wherein a toothed wheel having outer toothing is fixedly disposed on the conveying shaft, said toothed wheel is enclosed by an outer ring supporting the friction coating, the outer ring having an inner toothing constantly meshes with the outer toothing of the toothed wheel, a partial circle diameter of the toothed wheel is smaller than the inner toothing of the outer ring, a force transferred acts on the outer ring such that the outer ring is placed with a contact force onto on the sheet to be conveyed, and a spacer maintains a fixed spacing between an axis of rotation of the toothed wheel and an axis of rotation of the outer ring.

The spacer can be disposed inside the outer ring. The conveying shaft as well as a bearing of the outer ring in the spacer can be pivoted with a fixed spacing between one another. The force can be transferred into the outer ring for generating the contact force by means of a lever resting against the outer circumference. The lever can be disposed such that the force is transferred essentially perpendicularly to the sheet to be conveyed. The lever may act together with a sensor and wherein a defined contact force is transferred onto the sheet based on the sensor information when the driven conveying shaft approaches the sheet stack. The sensor can be an optical sensor. The lever can be stressed by the force of a spring whereby the spring can be disposed such that the contact force of the outer ring on the sheet to be conveyed is essentially constant during different deflections of the lever.

The essential thought of the invention is to provide an enforced coupling between the toothed wheel and the outer ring having a friction coating such that the toothed wheel meshes with the inner toothing of the outer ring independently of the position of the toothed wheel relative to that of the outer ring. A spacer is used to provide the enforced coupling, preferably inside the outer ring. The spacer preferably comprises two spaced receptacles for providing a rotative bearing for the driving conveying shaft of the toothed wheel and a central bearing for the outer ring. Of course, ball bearings can be provided in the receptacles in order to prevent friction between the conveying shaft and the spacer as well as between the bearing, e.g. bearing pin or bearing axle and the spacer. The spacing between the centers of the receptacles corresponds to the difference between the radius of the inner toothing and the radius of the toothed wheel. Since the toothing of the toothed wheel and that of the outer ring are constantly in mesh, a standard toothing can be selected between the toothed wheel and the outer ring.

The toothed wheel sets the outer ring into constant rotation and the action of a defined force, is placed with a force component onto the sheet to be conveyed in order to generate the sheet conveying force.

In a preferred embodiment of the present invention, the defined force is transferred into the outer ring for generating the contact force (normal force) by means of a lever, whereby the lever is disposed such that the force is transferred essentially perpendicularly to the sheet to be conveyed. For this purpose, the lever is disposed, for example, parallelly to the sheet stack and rests outwardly against the circumference of the outer ring in a region without any friction coating. By the embodiment of the sheet conveyor according to the present invention, the required contact force, and thus the working point is reached even with a small deflection of the outer ring. An additional advantage is that a compression of the sheet stack due to the contact force of the outer ring has little or no effect on the contact force of the outer ring having the friction coating on the sheet to be conveyed.

It is expedient to simultaneously design the lever used for the force transmission as a sensor lever that works together with a sensor, particularly an optical sensor, whereby a defined contact force on the sheet is derived based on the sensor information when the driven conveying shaft approaches the sheet stack. Here, the point of contact between the spring acting on the lever and the lever as well as the base suspension point of the spring on a component that is fixed relative to the pivot of the lever are positioned taking into consideration that the distance of the contact point of the lever on the outer ring from the pivot of the lever increases in direct proportion to the deflection of the outer ring from its rest position. The point of contact as well as the base suspension point are selected such that the effective contact force of the outer ring on the sheet to be conveyed is largely independent of the deflection of the outer ring from its rest position. The spring force acting on the lever thus remains almost constant even in wide deflection ranges of the lever. Due to the fact that the contact force is constant, the conveying force that acts on the sheet to be conveyed and that is calculated as the product of the contact force and the friction coefficient between the friction coating and the sheet also remains constant.

BRIEF DESCRIPTION OF THE DRAWINGS

The present invention is explained more elaborately in the following description on the basis of a preferred embodiment and the drawings of which.

DETAILED DESCRIPTION

A sheet-collecting device as an additional device for a printer or for a copier is configured to collect the printed pages from the printer and deposit the pages in sorted form on a stack of up to 3000 sheets, for example.

In doing so, the sheets may be deposited evenly as individual sheets, or as part of a printing job set which can be collected in a separate collection module of the device. The printing job set can be aligned flush with the edges and, if necessary, can also be stapled as a sheet.

Figure 1:
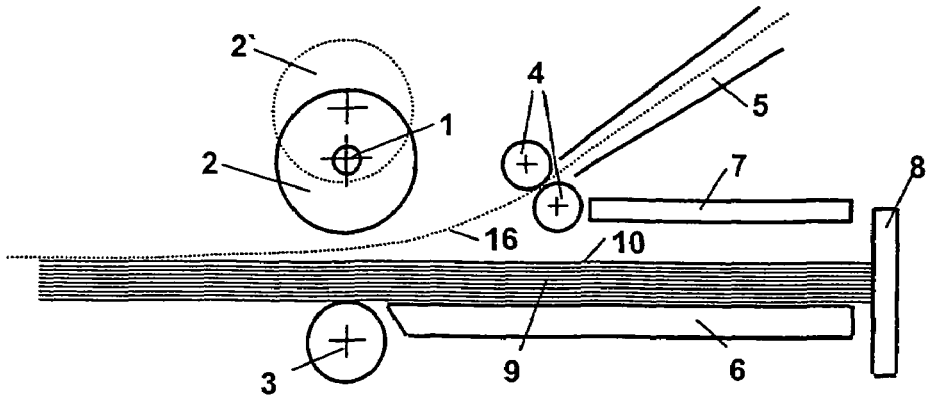
FIG. 1 is a schematic illustration of a stacking tray in an office machine for collecting and aligning individual sheets to form a sheet stack.

FIG. 1 illustrates the stacking tray of the stacking module having the function-determining elements.

An arriving sheet is guided into the sheet guidance channel 5 along the sheet intake line 16 and conveyed by the sheet feeding rollers 4.

The sheet conveyor 2 is raised from the sheet stack 9 and is disposed in position 2'. The arriving sheet thus slides onto the sheet stack 9.

When the rear edge of the arriving sheet has left the sheet feeding rollers 4, a conveying shaft 1 that is driven by a motor (not illustrated) using a toothed wheel 26, with the sheet conveyor 2, is lowered onto the sheet stack 9 and conveys the uppermost sheet 10 on the sheet stack 9 in the opposite direction and up to an alignment edge 8. In addition to the sheet conveyor, it is also possible to provide a roller having rubberized fingers that is responsible for conveying the sheet 10 over the last section up to the alignment edge 8.

Through the automatically limited conveying force of the sheet conveyor 2, the conveyed sheet 10 can automatically align itself to the alignment edge 8 and is subsequently disposed in precisely the same position as all sheets of the sheet stack 9.

Figure 2A:
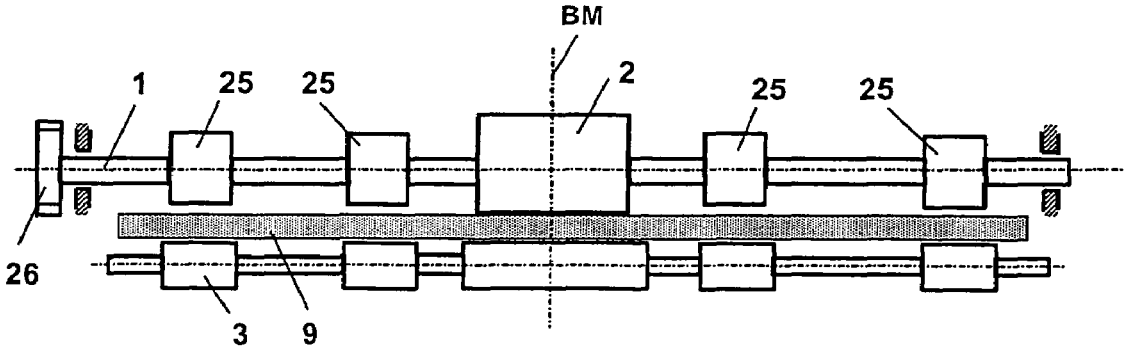
FIG. 2*a* illustrates a sheet conveyor with a driven conveying shaft disposed centrally with respect to a sheet.
Figure 2B:
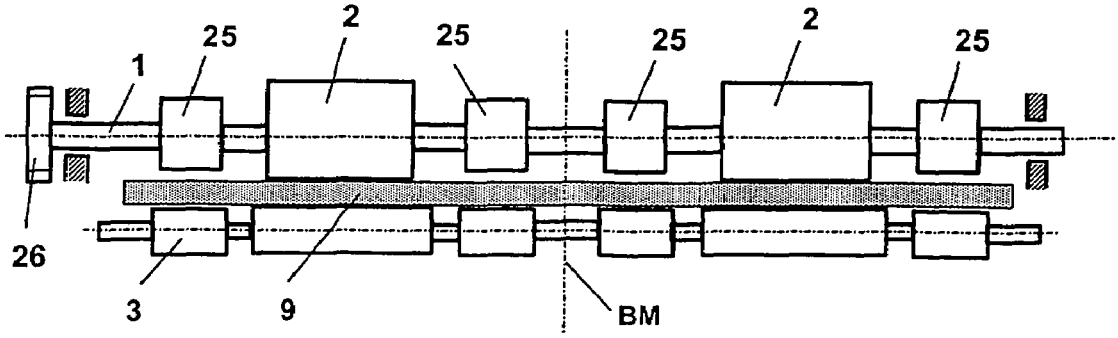
FIG. 2*b* is a configuration of two sheet conveyors on the driven conveying shaft disposed symmetrically with respect to the sheet center BM.

FIG. 2 illustrates possible configurations of the sheet conveyor 2 on the driven conveying shaft 1. FIG. 2*a* illustrates only a sheet conveyor disposed centrally with respect to the sheet, whereas FIG. 2*b* illustrates two sheet conveyors 2 disposed symmetrically with respect to the sheet center. Conveyors in which the sheet conveyor is disposed asymmetrically with respect to the arriving sheets are also feasible.

Figure 3:
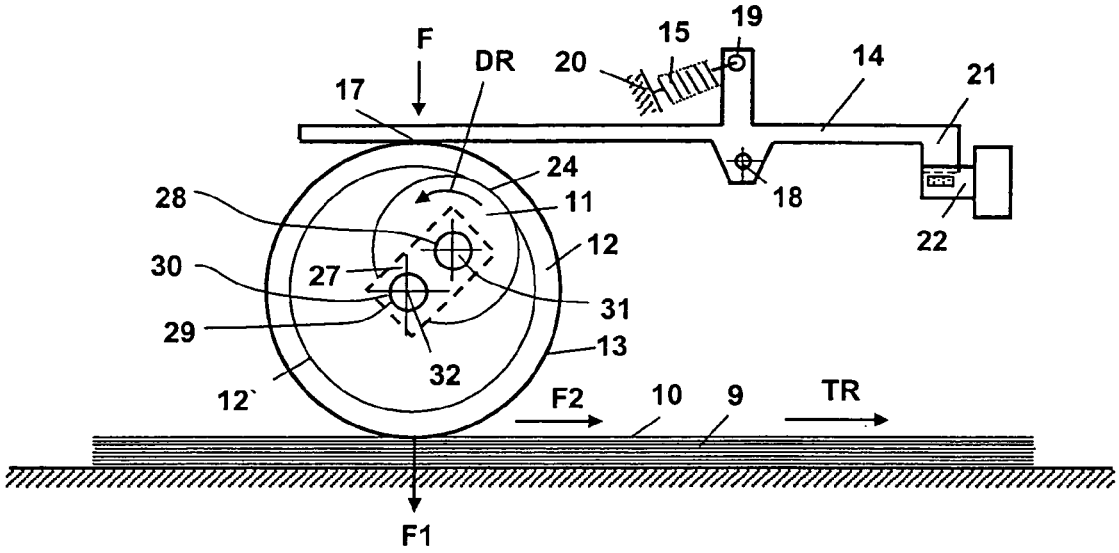
FIG. 3 is an illustration of the function elements of the sheet conveyor in a position for conveying the uppermost sheet on the sheet stack.
Figure 4:
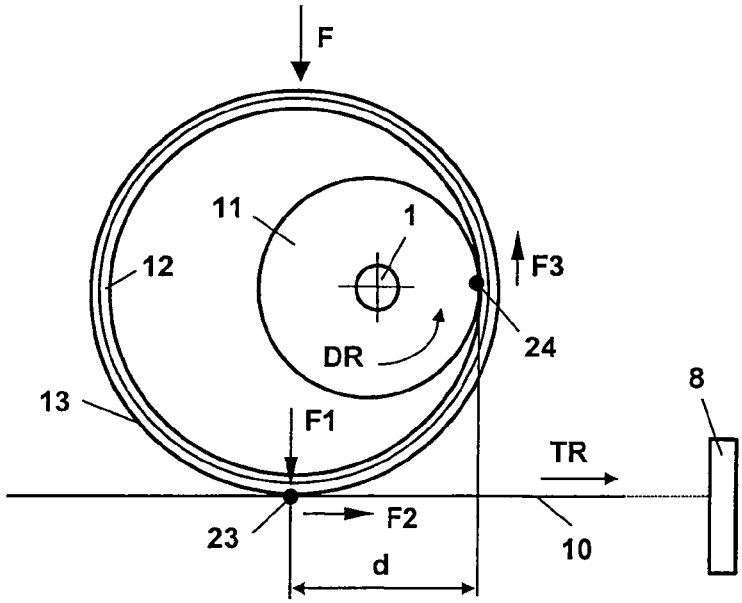
FIG. 4 is a schematic illustration to explain the function of the sheet conveyor.

FIG. 3 illustrates the essential functional elements of the sheet conveyor 2. The figure illustrates the sheet conveyor 2 placed onto the sheet stack 9 in its operating position. A toothed wheel 11 that is disposed fixedly on the driven conveying shaft 1, meshes at the engagement point 24 with the inner toothing 12' of the outer ring 12.

The partial circle diameter of the toothed wheel 11 is markedly smaller than the inner toothing 12' of the outer ring 12. Thereby the engagement point 24 of the outer ring 12 can move around in relation to the toothed wheel 11. A lever 14, which is supported rotatably in pivot 18 and is pre-stressed by a compression spring 15, lies in a contact point 17 outwardly on the outer ring 12 and transfers a force F onto the outer ring 12. The lever 14 is disposed parallelly to the sheet stack 9 so that the transferred force F is transferred onto the highest point possible of the outer ring 12 and perpendicularly to the sheet 10 to be conveyed in the outer ring 12. Here, the compression spring 15 is disposed in such a way that the contact force F1 of the outer ring 12 on the sheet 10 is essentially constant during the different deflections of the lever 14. For this purpose, the point of contact 19 of the compression spring 15 as well as the base suspension point 20 on a component that is fixed relative to the pivot 18 must be selected accordingly.

An enforced coupling is provided between the toothed wheel 11 and the outer ring 12 by using a spacer 27 inside the circumference of the outer ring 12. The spacer 27 comprises two recesses 28, 29 whereby the driven conveying shaft is rotatably supported in the recess 28 and a bearing 30 of the outer ring 12 is rotatably mounted in the recess 29. The spacing between the axis 31 of the toothed wheel 11 and the axis 32 of the outer ring 12 corresponds to the difference between the radius of the inner toothing and the radius of the toothed wheel 11. Using the spacer 27, the toothing of the toothed wheel 11 meshes with the inner toothing 12' of the outer ring 12 independently of the position of the toothed wheel 11 in relation to the outer ring 12. The lever 14 for applying the force F on the outer ring 12 is simultaneously designed as a sensor lever and it senses the position of the outer ring 12. A sensor 22 that works together with a sensor flag 21 of the lever 14 detects whether the outer ring 12 is in contact with the sheet stack. If necessary, it can also detect the degree of the deflection of the lever 14.

In FIG. 3 the spacing between the axis 31 of the toothed wheel 11 and the uppermost sheet 10 of the sheet stack 9 is set in such a way that the outer ring 12 having the friction coating 13 rests on the uppermost sheet 10 of the sheet stack 9. Upon rotation of the driven conveying shaft 1 in the direction of rotation DR illustrated, a sheet conveying force F2 is generated which moves the uppermost sheet 10 in the direction of conveyance TR.

In order to attain the correct normal force component F1 at the contact point 23 of the outer ring 12 on the sheet stack 9, the spacing of the axis 31 from the uppermost sheet 10 is decreased until the sensor 22 over the lever 14 having the sensor flag 21 detects a predetermined deflection of the lever 14 and thus a predetermined force F exists.

The basic function of the sheet conveyor 2 is explained on the basis of 4. At the contact point 23 of the friction coating 13, the contact force F1 results due to the force F applied perpendicularly to the sheet stack 9. The direction and the amount of the contact force F1 is almost identical to the force F transferred using the lever 14.

Due to the transmission of the force F perpendicularly to the sheet stack 9 into the outer ring 12, a compression of the sheet stack caused by the contact force F1 of the outer ring 12 has no effect on the contact force of the outer ring 12 on the sheet 10 to be conveyed. Thus the conveying force F2 is also independent of this. An additional advantage is the constancy of the force F1 in a wide deflection range of the lever 14 and/or of the outer ring 12.

As explained earlier, an enforced coupling is provided between the outer toothing of the toothed wheel 11 and the inner toothing 12' of the outer ring 12 using the spacer 27. They mesh with each other at the engagement point 24.

When the toothed wheel 11 is driven via the driven conveying shaft 1 in the direction of rotation DR illustrated, a force having a force component F3 is generated in the direction of rotation onto the outer ring 12 perpendicularly away from the sheet stack 9. The force component F3 generates at contact point 22, a force component F2, which moves the sheet 10 in the direction of conveyance TR.

The contact force F1 and the force F3 are directed oppositely. When the coefficient of friction between the friction coating 13 and the sheet 10 to be conveyed is greater than the coefficient of friction between the sheet 10 to be conveyed and the sheet stack 9, the force F3 that is applied through the driven toothed wheel 11 and counteracts the contact force F1 is always smaller than the contact force F1. Through the net magnitude of F1 a force F2 always results, which conveys the sheet.

If the sheet 10 is decelerated, the force F3, which is applied via the toothed wheel 11, increases. Through the increase of the force F3, with a constant force F, the force F1 at contact point 23 is reduced and, via the coefficient friction, also the force component F2 in the direction of conveyance TR of sheet 10.

The friction coating 13 thereby changes from adhering friction on the sheet 10 into sliding friction with reduced frictional force.

Through the spacing d between the engagement point 24 of the toothing and the contact point 23 between the friction coating 13 and the uppermost sheet 10, the sheet 10 is always pulled and cannot become jammed when sheet 10 is blocked.

After the desired number of sheets is deposited onto the sheet stack 9, the sheet stack 9 can be conveyed further as a set. For this purpose, the conveying shaft 1 is lowered until the friction rollers 25 engage the sheet stack 9. Here, the outer ring 12 swings into a position of maximum deflection. The friction rollers 25 staple the sheet stack 9 using the counter rollers 3 and convey the sheet stack 9 after the alignment edge 8 moves away in the horizontal direction.

Figure 5A:
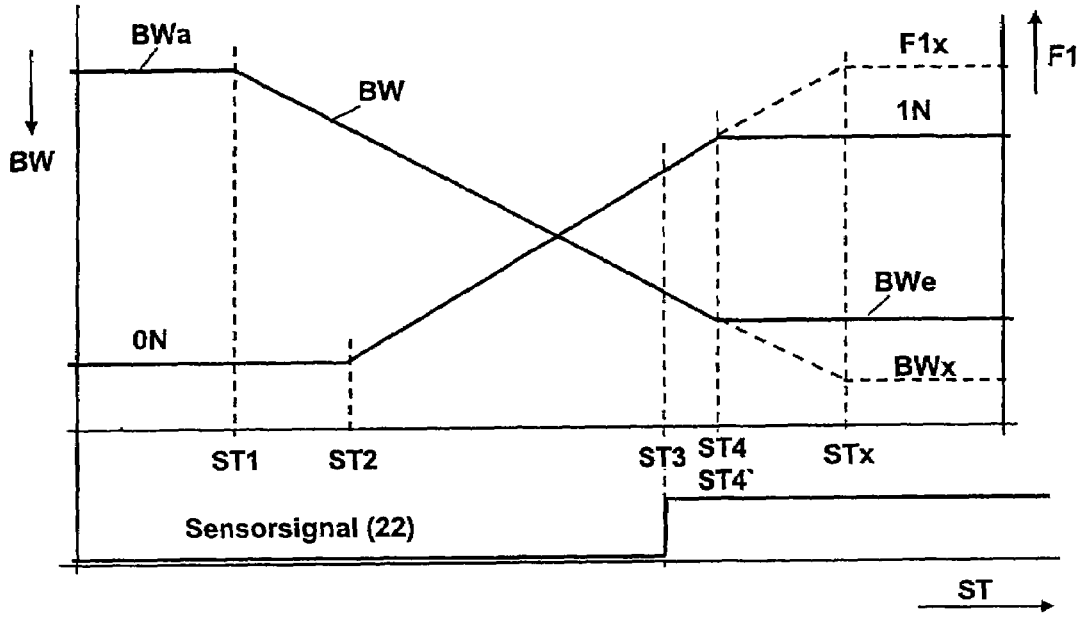
Fig. 5a (PRIOR ART)
FIG. 5*a* is a diagram illustrating the application of the spacing of the sheet conveyor from the sheet 10 as well as the application of the contact force F1 over the step position of the drive motor in the prior art and FIG. 5*b* is a diagram illustrating the application of the spacing of the sheet conveyor from the sheet 10 as well as the application of the contact force F1 over the step position of the drive motor in the sheet conveyor according to the present invention.

The diagram in FIG. 5*a* illustrates the application of the spacing of the sheet conveyor (BW) from the uppermost sheet 10 as well as the contact force F1 over the step position of the drive motor that drives the conveying shaft 1 in a sheet conveyor of prior art according to the patent application DE 198 44 271 C1. First the sheet conveyor 2 is displaced from an initial position (BWa) that is spaced from the sheet 10 downwards in the direction of sheet 10. In a step position ST2, the outer ring 12 of the sheet conveyor 2 reaches the sheet 10, due to which the contact force F1 increases somewhat linearly in an additional downward movement. In prior art, the contact force F1 increases slowly due to which the outer ring 12 has to be deflected very widely in order to attain the desired contact force of IN. In a step position ST3 and/or in case of a corresponding contact force F1, the sensor is activated via a sensor flag, and a sensor signal (stop signal for the step motor) is emitted. Due to this, the step motor and thus the sheet conveyor 2 slow down. Consequently, the step motor comes to a halt in a step position ST4. In the ideal case, the step position ST4 is identical to a step position ST4' in which the desired contact force of IN is attained. In a sheet conveyor according to prior art, the sensor has to be adjusted in such a way that it is activated in time before attaining the contact force of IN in order to ensure that the step motor and thus the sheet conveyor 2 come to a halt at the desired contact force of IN in the end position BWe. If additional steps were carried out by the step motor after reaching the step position ST4', the contact force F1 would proceed as indicated by the dashed line Fix. Thus the contact force F1 would increase further and result in damaging the sheet 10.

Figure 5B:
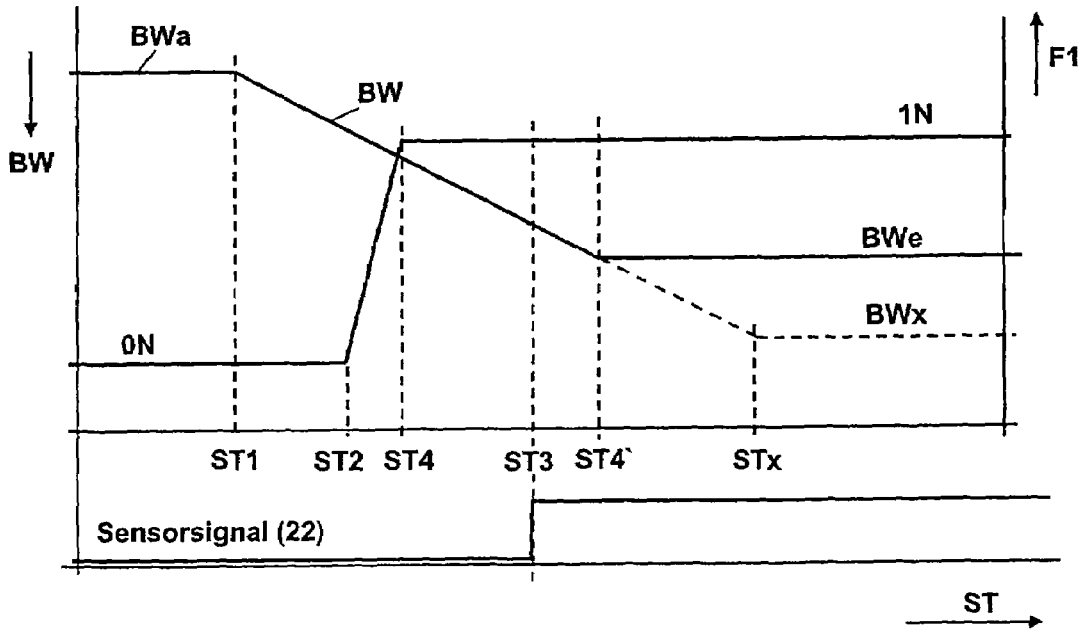

The diagram in FIG. 5*b* illustrates the application of the spacing of the sheet conveyor (BW) from the uppermost sheet 10 as well as the contact force F1 over the step position of the drive motor of the conveying shaft 1 in the sheet conveyor according to the present invention. Here also, the sheet conveyor 2 is first displaced from an initial position (BWa), which is spaced from the sheet 10, downwards in the direction of the sheet 10. In a step position ST2, the outer ring 12 of the sheet conveyor 2 reaches the sheet 10, due to which the contact force F1 increases in an additional downward movement of the sheet conveyor 2. As opposed to the prior art, in the sheet conveyor according to the present invention, the contact force F1 increases due to the perpendicular force transfer until it corresponds to the desired contact force of IN in step position ST4. Even if the sheet conveyor 2 moves further downward, the contact force F1 does not change, instead it remains constant at IN. In a desired deflection of the outer ring 12, the sensor is activated due to which a stop signal is emitted to the step motor. The step motor initiates the method of deceleration and comes to a halt in the step position ST4'. In the corresponding path of the sheet conveyor 2 in the direction of the sheet 10, the contact force F1 does not change. It remains constant at IN. Due to this, the precise adjustment of the sensor, which was necessary in prior art, can be omitted. If the step motor were to continue to carry out additional steps after the step position ST4' and if the sheet conveyor 2 were lowered further in the direction of the sheet 10 (dashed line), the force F1 would continue to remain constant, as illustrated, on the basis of the embodiment of the sheet conveyor according to the present invention.

LIST OF REFERENCE SYMBOLS

1 Driven conveying shaft
2 Sheet conveyor
2' Sheet conveyor in a raised position
3 Lower pressure shaft with counterrollers
4 Sheet feeding rollers
5 Sheet guidance channel
6 Contact for collected sheets
7 Upper limit of the stacking tray
8 Alignment edge
9 Stack of collected sheets

10 Uppermost sheet of the sheet stack (9)
11 Toothed wheel with outer toothing
12 Outer ring with inner toothing
12' Inner toothing of the outer ring (12)
13 Friction coating on the outer ring (12)
14 Lever for applying a force (F) on the outer ring (12)
15 Compression spring for applying the force (F) using the lever
16 Sheet intake line
17 Contact point of the lever (14) on the outer ring (12)
18 Pivot for the lever (14)
19 Point of contact of the compression spring (15) on the lever (14)
20 Base suspension point of the compression spring (15) on a component
21 Sensor flag
22 Optical sensor flag
23 Contact point of the friction coating (13) on the uppermost sheet (10)
24 Engagement point of the toothing of toothed wheel (11) and the outer ring (12)
25 Friction rollers on the driven conveying shaft (1)
26 Drive toothed wheel for the driven conveying shaft (1)
27 Spacer
28 Recess in the spacer (27) for the conveying shaft (1)
29 Recess in the spacer (27) for the bearing shaft (30)
30 Bearing of the outer ring (12)
31 Axis of rotation of the toothed wheel (11)
32 Axis of rotation of the outer ring (12)
BM Sheet center
d Spacing from the engagement point (24) of the toothed wheels (11) and (12) to the contact point (23) of the friction coating (13) on the uppermost sheet (10)
DR Direction of rotation of the driven conveying shaft (1)
TR Direction of conveyance for the uppermost sheet (10)
F Force on the outer ring (12)
F1 Contact force of the sheet conveyor (2) on the sheet (10)
F2 Sheet conveying force
F3 Force in the engagement point (24) perpendicularly away from the sheet stack
ON The contact force F1 amounts to 0 Newton
IN The contact force F1 amounts to 1 Newton
BW Spacing of the sheet conveyor (2) from the sheet (10)
BWa Initial position of the sheet conveyor (2) before the start of the movement
BWe End position of the sheet conveyor (2) on the step position (ST4)
BWx Position of the sheet conveyor (2) on the step position STx
Fix Contact force of the sheet conveyor (2) on the sheet (10) on the position STx
ST Steps for the step motor that moves the sheet conveyor (2) in the direction of the sheet (10)
ST1 First step using which the sheet conveyor is moved to the sheet (10)
ST2 Step position in which the sheet conveyor comes into contact with the sheet (10)
ST3 Step position in which the optical sensor (22) is activated
ST4 Step position in which the desired contact force is achieved
ST4' Stop position for the sheet conveyor (2)
STx Random step position

What is claimed is:

1. A sheet conveyance system for conveying individual sheets on a sheet stack, comprising at least one driven conveying shaft, whose spacing from the sheet stack is variable and that contains at least one sheet conveyor that acts with a friction coating on a sheet to be conveyed, wherein a toothed wheel having outer toothing is fixedly disposed on the conveying shaft, said toothed wheel is enclosed by an outer ring supporting the friction coating, the outer ring having an inner toothing constantly meshes with the outer toothing of the toothed wheel, a partial circle diameter of the toothed wheel is smaller than the inner toothing of the outer ring, a force transferred acts on the outer ring such that the outer ring is placed with a contact force onto on the sheet to be conveyed, and a spacer maintains a fixed spacing between an axis of rotation of the toothed wheel and an axis of rotation of the outer ring, wherein the spacer is disposed inside the outer ring.

2. A sheet conveyor according to claim 1, wherein the conveying shaft as well as a bearing of the outer ring are pivot-mounted within the spacer and have a fixed spacing between one another.

3. A sheet conveyor according to claim 1, wherein the force is transferred into the outer ring for generating the contact force by means of a lever resting against the outer circumference.

4. A sheet conveyor according to claim 3, wherein the lever is disposed such that the force is transferred essentially perpendicularly to the sheet to be conveyed.

5. A sheet conveyor according to claim 3, wherein the lever acts together with a sensor and wherein a defined contact force is transferred onto the sheet based on the sensor information when the driven conveying shaft approaches the sheet stack.

6. A sheet conveyor according to claim 5, wherein the sensor is an optical sensor.

7. A sheet conveyor according to claim 3, wherein the lever is stressed by the force of a spring whereby the spring is disposed such that the contact force of the outer ring on the sheet to be conveyed is essentially constant during different deflections of the lever.

8. A sheet conveyance system for conveying individual sheets on a sheet stack, comprising:

at least one driven conveying shaft, whose spacing from the sheet stack is variable, at least one sheet conveyor that acts with a friction coating on the sheet to be conveyed, a toothed wheel having outer toothing fixedly disposed on the conveying shaft and having a partial circle diameter, an outer ring supporting the friction coating and enclosing the toothed wheel and having an inner toothing that constantly meshes with the outer toothing of the toothed wheel, wherein the partial circle diameter of the toothed wheel is smaller than the inner toothing of the outer ring, and a transferred force acts on the outer ring such that the outer ring is placed with a contact force onto on the sheet to be conveyed, and a spacer maintaining a fixed spacing between an axis of rotation of the toothed wheel and an axis of rotation of the outer ring, wherein the spacer is disposed inside the outer ring.

9. A sheet conveyor according to claim 8, wherein the conveying shaft as well as a bearing of the outer ring are pivot-mounted within the spacer and have a fixed spacing between one another.

10. A sheet conveyor according to claim 8, wherein the force is transferred into the outer ring for generating the contact force by means of a lever resting against the outer circumference.

11. A sheet conveyor according to claim 10, wherein the lever is disposed such that the force is transferred essentially perpendicularly to the sheet to be conveyed.

12. A sheet conveyor according to claim 10, wherein the lever acts together with a sensor and wherein a defined contact force is transferred onto the sheet based on the sensor information when the driven conveying shaft approaches the sheet stack.

13. A sheet conveyor according to claim 12, wherein the sensor is an optical sensor.

14. A sheet conveyor according to claim 10, wherein the lever is stressed by the force of a spring whereby the spring is disposed such that the contact force of the outer ring on the sheet to be conveyed is essentially constant during different deflections of the lever.

15. A sheet conveyance system for conveying individual sheets on a sheet stack, comprising:

at least one driven conveying shaft, whose spacing from the sheet stack is variable, at least one sheet conveyor that acts with a friction coating on the sheet to be conveyed, a toothed wheel having outer toothing fixedly disposed on the conveying shaft and having a partial circle diameter, a rigid outer ring supporting the friction coating and enclosing the toothed wheel and having an inner toothing that constantly meshes with the outer toothing of the toothed wheel, wherein the partial circle diameter of the toothed wheel is smaller than the inner toothing of the rigid outer ring, and a transferred force acts on the rigid outer ring such that the rigid outer ring is placed with a contact force onto on the sheet to be conveyed, and a spacer disposed inside the rigid outer ring maintaining a fixed spacing between an axis of rotation of the toothed wheel and an axis of rotation of the rigid outer ring, wherein the conveying shaft as well as a bearing of the rigid outer ring are pivot-mounted within the spacer and have a fixed spacing between one another.

16. A sheet conveyor according to claim 15, wherein the force is transferred into the outer ring for generating the contact force by means of a lever resting against the outer circumference.

17. A sheet conveyor according to claim 16, wherein the lever is disposed such that the force is transferred essentially perpendicularly to the sheet to be conveyed.

18. A sheet conveyor according to claim 17, wherein the lever acts together with a sensor and wherein a defined contact force is transferred onto the sheet based on the sensor information when the driven conveying shaft approaches the sheet stack, and wherein the lever is stressed by the force of a spring whereby the spring is disposed such that the contact force of the outer ring on the sheet to be conveyed is essentially constant during different deflections of the lever.

* * * * *